US008133092B2

(12) United States Patent
Arcona et al.

(10) Patent No.: US 8,133,092 B2
(45) Date of Patent: Mar. 13, 2012

(54) SYSTEM AND METHOD FOR IMPROVED HAND TOOL OPERATION

(75) Inventors: Christopher Arcona, Rutland, MA (US); Douglas A Wakefield, Worcester, MA (US); Brahmanandam Tanikella, Northborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 821 days.

(21) Appl. No.: 11/833,636

(22) Filed: Aug. 3, 2007

(65) Prior Publication Data

US 2008/0032601 A1 Feb. 7, 2008

Related U.S. Application Data

(60) Provisional application No. 60/835,403, filed on Aug. 3, 2006.

(51) Int. Cl.
*B24B 49/00* (2006.01)

(52) U.S. Cl. ..... 451/5; 451/357

(58) Field of Classification Search ..... 451/5, 357, 451/359, 270, 27, 295
See application file for complete search history.

(56) References Cited

U.S. PATENT DOCUMENTS

| | | | | |
|---|---|---|---|---|
| 4,410,846 | A * | 10/1983 | Gerber et al. | 318/490 |
| 4,513,381 | A * | 4/1985 | Houser et al. | 700/168 |
| 5,937,370 | A | 8/1999 | Lysaght | |
| 6,736,698 | B2 * | 5/2004 | Moore | 451/5 |
| 7,270,591 | B2 * | 9/2007 | Deshpande et al. | 451/5 |
| 7,504,791 | B2 * | 3/2009 | Sieber et al. | 318/433 |
| 7,722,435 | B2 * | 5/2010 | King | 451/5 |

FOREIGN PATENT DOCUMENTS

| | | | |
|---|---|---|---|
| EP | 0588057 | A2 | 3/1994 |
| WO | 2005070624 | A1 | 8/2005 |

* cited by examiner

*Primary Examiner* — Robert Rose
(74) *Attorney, Agent, or Firm* — Abel Law Group, LLP; Joseph P. Sullivan

(57) ABSTRACT

Systems and methods for improved operation of hand tools are disclosed. Sensors may be configured to monitor one or more operational parameters of a hand tool and collected data may be communicated to the hand tool operator. The data may be compared to predetermined limits for an operational parameter to enable real-time operational diagnostics and quantitative control. Data can be collected across a manufacturing facility and analyzed to help account for variations in technique and skill among operators. An understanding of relationships between monitored operational parameters can lead to improved consistency among finished products and reduction in manufacturing costs. Data may also be stored for future recall and analysis.

24 Claims, 13 Drawing Sheets

| Parameter | New Disc | Used Disc |
|---|---|---|
| Fn | 5.8 | 16.7 |
| Orbital rpm | 9450 | 9015 |
| Rotational rpm | 415 | 360 |
| Air Pressure | 60 | 60 |

FIG. 10

SYSTEM AND METHOD FOR IMPROVED HAND TOOL OPERATION

CROSS-REFERENCE TO RELATED APPLICATION

This application claims priority under 35 U.S.C. §119(e) to U.S. Provisional Application Ser. No. 60/835,403 filed on Aug. 3, 2006, entitled "SYSTEM AND METHOD FOR IMPROVED HAND TOOL OPERATION," which is hereby incorporated herein by reference in its entirety for all purposes.

BACKGROUND OF THE INVENTION

1. Field of the Invention

At least one embodiment of the present invention relates generally to systems and methods for hand tool operation and, more particularly, to systems and methods for quantitative analysis and control of hand tool operation.

2. Discussion of Related Art

Hand tools are commonly used in a wide range of industries including the automotive, marine and woodworking industries. In some applications, these manual or offhand tools may be involved in a finishing operation following a series of machining processes. Hand-held grinders, for example, may be used to smooth surfaces of manufactured goods. The quality and production cost of an end product may be impacted by the hand tool operator due to the involved human factor.

BRIEF SUMMARY OF THE INVENTION

In accordance with one or more embodiments, the invention relates generally to systems and methods for hand tool operation.

In accordance with one or more embodiments, the invention relates to a hand tool monitoring system, comprising a sensor positioned to detect an operational parameter of a hand tool, and a controller in communication with the sensor, and configured to generate a signal based on data collected by the sensor and to communicate the signal to an operator of the hand tool.

In accordance with one or more embodiments, the invention further relates to a method of monitoring hand tool operation, comprising providing a sensor for detecting an operational parameter of a hand tool, collecting data with the sensor, and communicating the data collected by the sensor to an operator of the hand tool.

In accordance with one or more embodiments, the invention relates to a pneumatic hand tool monitoring system, comprising a sensor positioned to detect an operational parameter of the pneumatic hand tool, and a controller in communication with the sensor, configured to generate a signal based on data collected by the sensor, and further configured to communicate the signal to an operator of the pneumatic hand tool.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which:

FIG. 10 presents a summary of the data presented in FIGS. 8 and 9.

DETAILED DESCRIPTION OF THE INVENTION

Figure 1A:
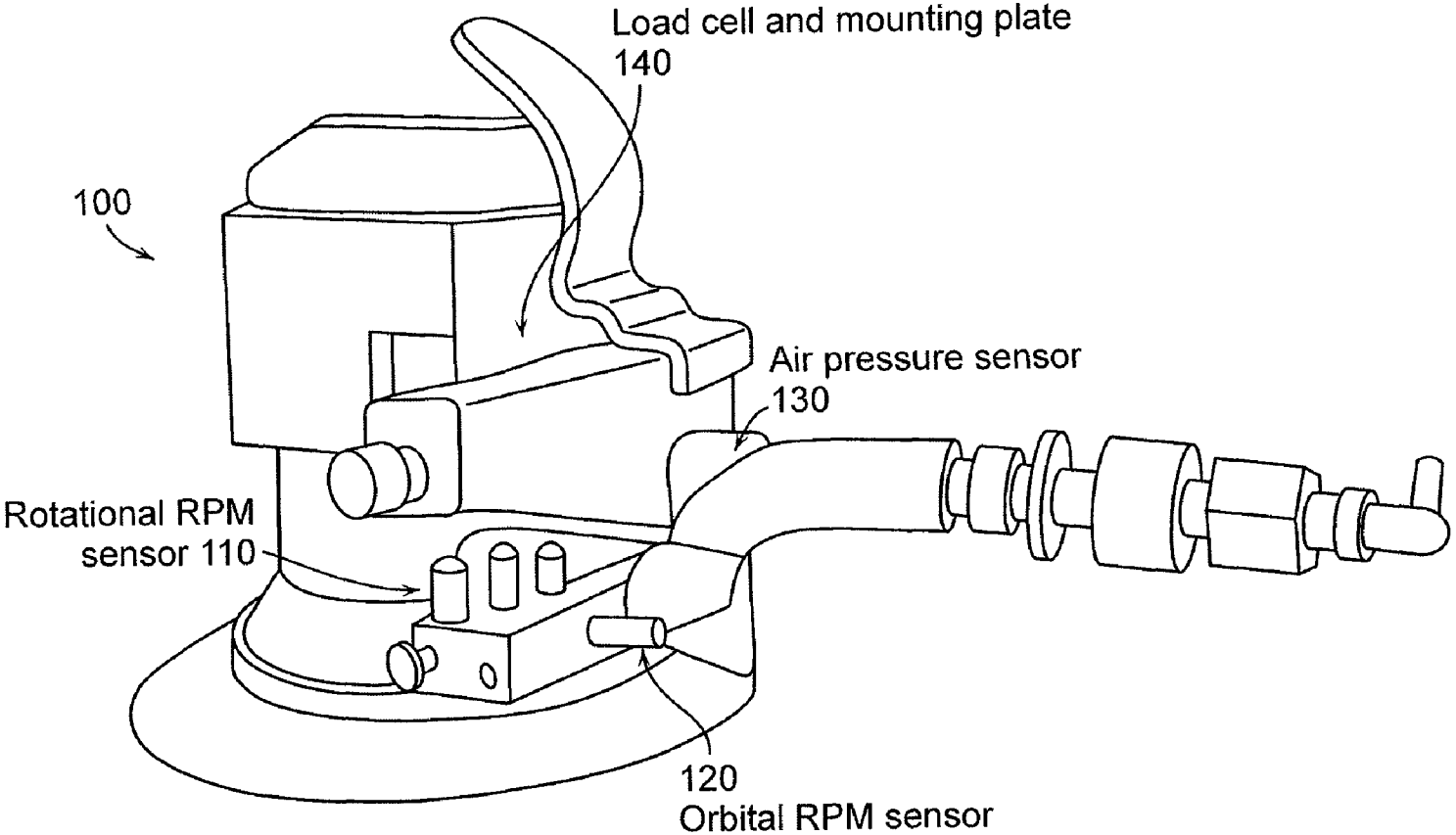
FIG. 1*a* presents an illustration of a hand tool instrumented with sensors in accordance with one or more embodiments of the present invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to one or more systems and methods for improved operation of hand tools. The systems and methods described herein may find applications in a wide variety of industries including, for example, the automotive, woodworking, and engineering industries, as well as others in which there may be a demand for increased control over hand tool operation and consistency among end products.

Embodiments of the present invention may generally involve a hand tool controlled by an operator. The hand tool may be any manual or offhand tool. In some embodiments, the hand tool may be used, for example, to machine or finish a work piece. The hand tool may be a pneumatic device, an electric device, or a device powered by any other source. In some embodiments, the hand tool may be a grinding or sanding device, such as a pneumatic or electric sander or grinder. In some embodiments, the grinder may be, for example, a horizontal shaft portable grinder, a straight shaft portable grinder, a die grinder, a pencil grinder, a right angle portable grinder or a vertical shaft cup grinder. In at least one embodiment, the hand tool may be a dual action grinder with both rotational and orbital motion, used to smooth or polish a work piece surface.

In accordance with one or more embodiments, the grinder may utilize an abrasive product, for example, a disc, thin wheel, sheet or other abrasive product, such as a coated abrasive, commonly known to those in the art. In some embodiments, the hand tool may use a bonded abrasive, such as an organically or vitrified bonded abrasive. More specifically, the bonded abrasives may be cones, plugs, mounted points, straight snagging, or small cut-off abrasives. In other embodiments, the abrasive may be a resin and diamond cup wheel. In still other embodiments, the abrasive may be a thin wheel, such as a depressed center wheel. For example, one or more abrasive products as described in U.S. Pat. No. 6,846,223 to Conley et al., hereby incorporated herein by reference in its entirety for all purposes, may be used in one or more embodiments of the invention. In some embodiments, the hand tool may be a portable grinder using an abrasive product such as, for example, a cone, plug or portable grinding cup wheel prevalent in foundry and fabrication applications.

The surface of a utilized abrasive product may, for example, generally be of the conventional type in which abrasive grain is bonded to a backing material by the usual maker and size coat combinations, with or without a supersize layer conferring special grinding properties or characteristics. However, the abrasive product can also have an engineered surface comprising micro-replicated structures, such as pyramids or lines of parallel ridges, each of which comprises abrasive particles dispersed in a binder and adhered to a backing material. In some embodiments, the surface can comprise a layer of a formulation comprising abrasive particles dispersed in a binder resin and deposited in a relatively uniform layer, or in a contoured structure on a backing.

The abrasive particles used can be any of those typically made available for such purposes and range from alumina, alumina-zirconia and silicon carbide in the general purpose grinding area, to diamond, CBN, ceria, gamma alumina, and microcrystalline alpha alumina in the more specialized abrading applications. The binder component of the abrasive product can be selected from those known in the art for such applications. These include, for example, moisture-curable resins, thermosetting resins such as phenolic and epoxy-based resins, and radiation-curable resins such as acrylates, epoxy-acrylates, urethane-acrylates resins, and similar resins that are curable by visible or UV light as well as electron-beam radiation.

The operator may influence one or more operational parameters of the hand tool during use to impact the effect of the hand tool on the work piece. For example, the hand tool may include various controls and/or components which are adjustable by the operator. The operator may also manipulate the positioning and direction of the hand tool relative to the work piece. Thus, the operator may control operational parameters of the hand tool including, for example, supplied power (e.g. air pressure supplied to a pneumatic hand tool), supplied rate of air flow, applied force (e.g. a normal force provided perpendicular to a surface of the work piece), contact angle and/or rotational speed.

Variations in technique and skill among operators may contribute to inconsistent quality of end products, scrap generation, and increased manufacturing costs. A single hand tool operator may also be inconsistent between work pieces. Embodiments of the present invention may facilitate improved control of hand tool operation for process stability, uniformity and efficiency. More specifically, features of the present invention may provide process information to the operator in order to enable real-time process diagnostics.

Embodiments of the present invention may involve one or more sensors for monitoring process parameters of the hand tool. Systems which include sensors for monitoring a workpiece surface condition, such as roughness or temperature, are known. Instead, embodiments of the present invention detect operational parameters of the hand tool itself, enabling enhanced understanding of the mechanisms for surface generation, quantitative control and more sophisticated and/or intelligent engineering of tooling processes. Collected data, for example, may be analyzed to facilitate application-specific design and optimization of settings to achieve desired results. The operational parameter data may also allow for improved consistency and assist real-time operational diagnostics.

Figure 1B:
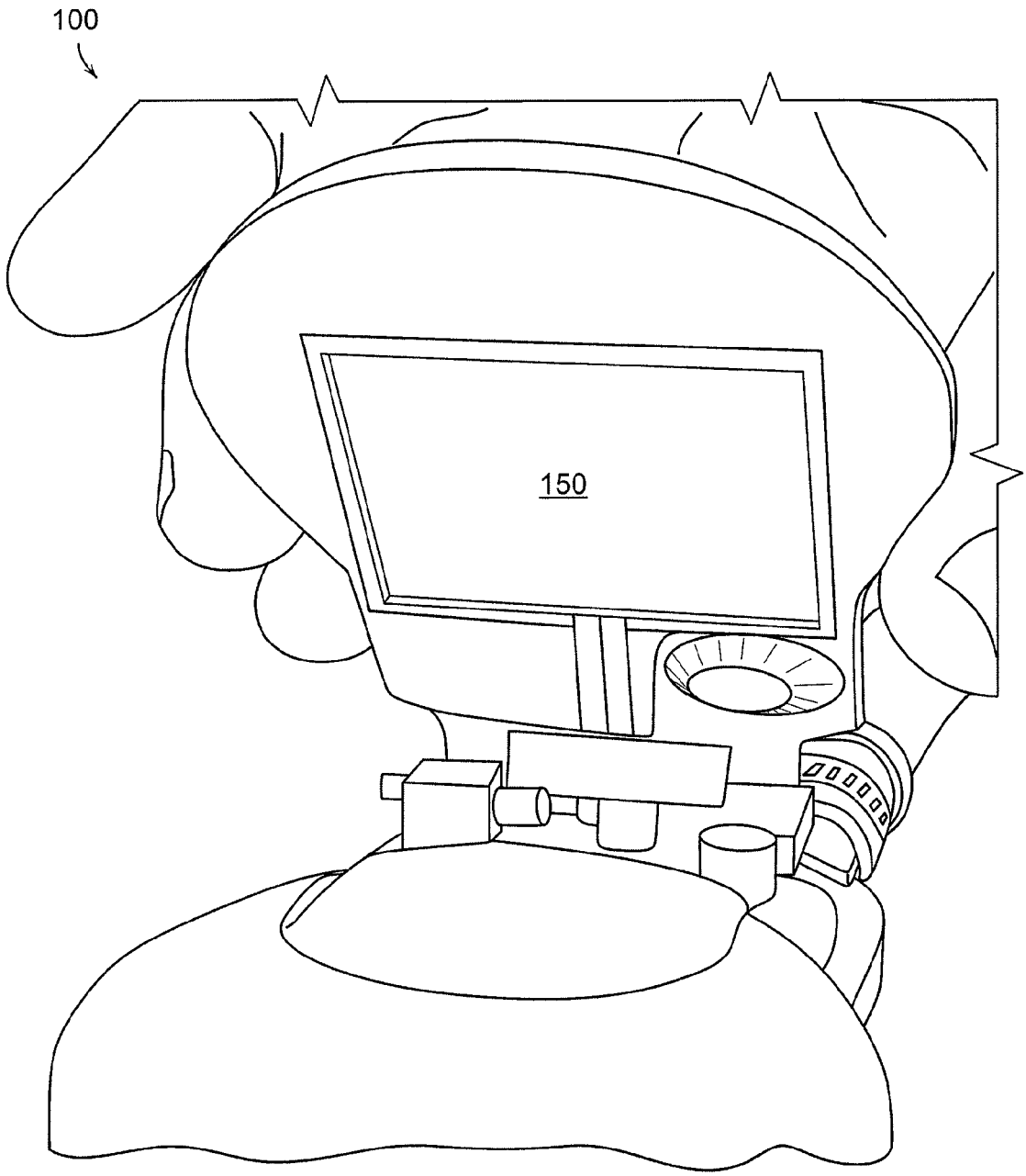
FIG. 1*b* presents an illustration of a hand tool instrumented with a force sensor in accordance with one or more embodiments of the present invention.

The sensor of the present invention may be any device configured to detect and quantify an operational parameter of the hand tool. In some embodiments, a hand tool 100 may be instrumented with one or more sensors 110, 120, 130 as illustrated in FIG. 1. Sensors 110, 120 and/or 130 may generally be configured to detect one or more operational parameters of hand tool 100 such as, but not limited to, supplied air pressure, orbital RPM, and rotational RPM. FIG. 1*b* illustrates one embodiment of the present invention in which a hand tool 100 is instrumented with a force sensor 150. The position of one or more sensors relative to hand tool 100 may vary depending on their function. For example, force sensor 150 may be mounted beneath a trigger of the hand tool 100 or in another position whereby force sensor 150 may detect an applied force. In at least one embodiment, force sensor 150 may be a film type sensor, such as a piezoresistive film type sensor. The hand tool 100 may also be equipped with load cell and/or mounting plate instrumentation 140 as illustrated in FIG. 1*a*. In other embodiments, a sensor may simply be directed at a work piece to monitor an operational parameter of the hand tool. In addition to those discussed above, other operational parameters of interest may relate to temperature, vibration, displacement, tilt, linear sweep, acoustic emission, acceleration, stock removal rate, as well as any other operational parameter that may be useful to monitor. In general, sensors may be selected based upon the intended application and process monitoring goals.

Figure 1C:
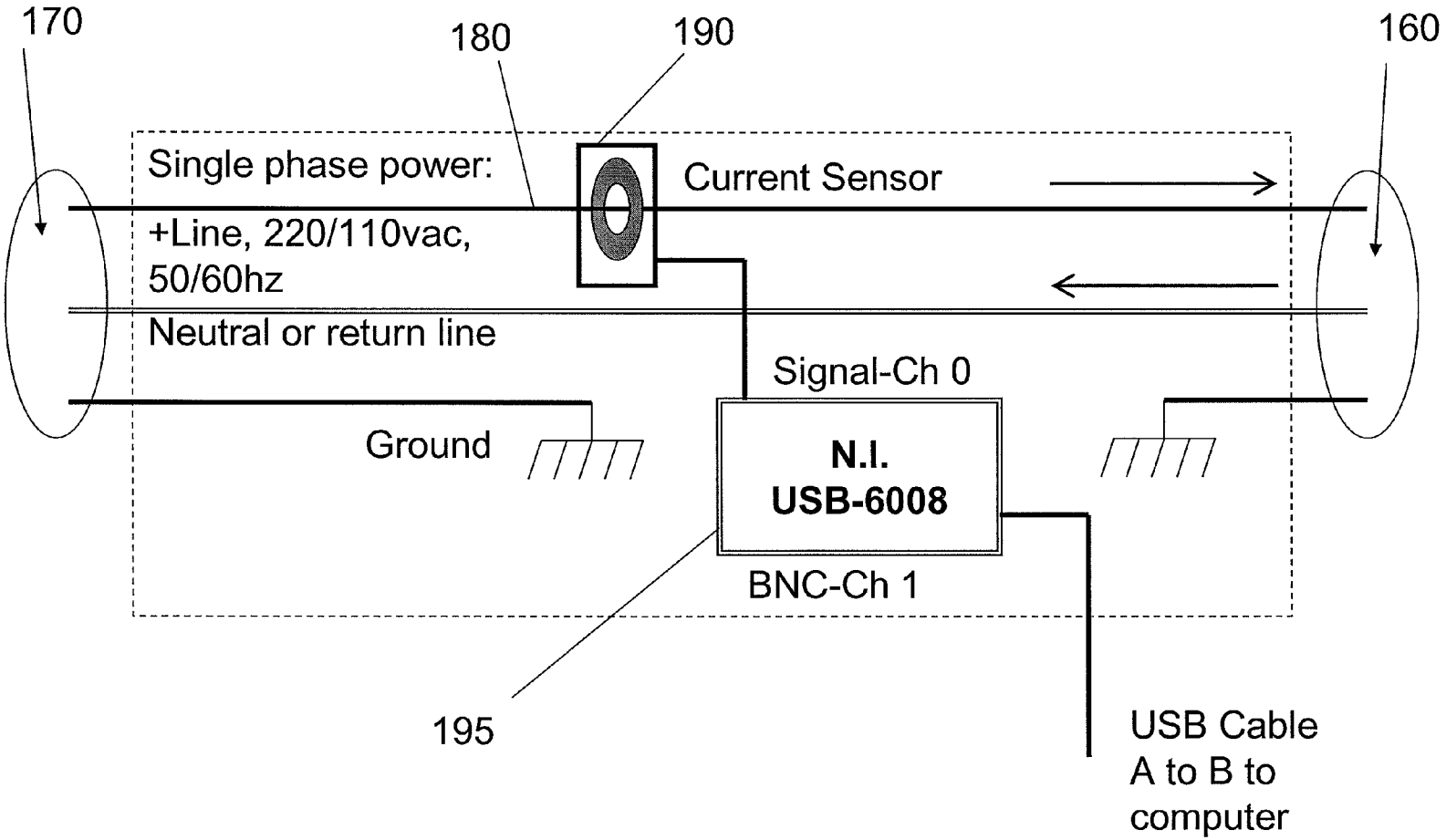
FIG. 1*c* presents an illustration of a setup for single phase current measurement for a hand tool in accordance with one or more embodiments of the present invention.

In accordance with one or more embodiments, power consumption of a hand tool may be monitored, as illustrated in FIG. 1*c*. For example, the power consumption of a portable hand-held grinder 160 may be measured. In some embodiments, the hand-held grinder may be an electric grinder, such as one that operates on alternating current (AC). For example, the electrical connection to the hand tool from power source 170 may be through a power cord 180, such as a standard 20 amp power cord. In at least one embodiment, the hand tool may be a single phase electric grinder used for manual operation with coated abrasive products such as, for example, fiber discs, non-woven discs and depressed center wheels.

Motor current data may be collected during use of the hand tool, such as during a grinding operation, by a current sensor 190. In some embodiments, a current sensor 190 may be configured to output a voltage proportional to motor current, which may be correlated to, or otherwise indicative of the grinding power of the hand tool. More specifically, current sensor 190 may be a magnetoresistive sensor, such as a single Hall effect type current transducer, configured to measure current supplied to the single-phase motor of the hand tool. In some embodiments, current sensor 190 may be positioned along power cord 180 as illustrated. In at least one embodiment, current sensor 190 may be an AT current sensor model AT1-010-000-FF current sensor commercially available from NK Technologies. A controller 195 may collect data on voltage output from current sensor 190. In some embodiments, software, such as Field Instrumentation System (FIS) software developed and owned by Saint-Gobain Abrasives, Inc., may be used to collect and analyze the motor current data. Output from current sensor 190 may be recorded and stored by the software for further analysis.

Embodiments of the present invention may further involve communicating the data collected by the sensor to the hand tool operator or to a process supervisor with a sensory signal. The sensory signal may be a visual, audible, vibratory or other signal. For example, a system in accordance with the present invention may further include a monitor upon which the data is visually displayed to the operator. In some embodiments, the data may be presented numerically, such as with a digital or analog signal, or with another visual signal. Audible cues, such as those involving varying volume or pitch levels, may also be used to communicate with the hand tool operator. This feedback may provide information which the operator can use to improve performance and consistency, such as to adjust an operational parameter in order to achieve manufacturing end requirements.

Predetermined limits for one or more operational parameters, such as upper and lower limits, may also be established and communicated to the operator or supervisor to aid in maintaining stable and consistent operation of the hand tool. For example, predetermined limits for applied pressure may be displayed for the operator along with the measured value as registered by a pressure sensor. The operator may observe the display continuously, periodically or otherwise, and make adjustments as necessary. More specifically, the operator may compare the measured value to the predetermined limits and adjust the operational parameter in order to bring the measured value within the predetermined limits.

Alternatively, comparison of registered values to the predetermined limits for an operational parameter may be performed by a system controller. For example, the controller may determine a deviation between a registered value and the predetermined limits and then generate a control signal based upon the deviation. The control signal may be communicated to the operator with a sensory signal such as a visual and/or audible cue. For example, a green LED may be displayed when the registered value is within the predetermined limits while a red LED may be displayed when the registered value falls outside the predetermined limits. In accordance with one or more embodiments, the controller may also offer safety functionality. In some embodiments, the controller may be configured to actuate an alarm when a registered value for an operational parameter falls outside a predetermined limit. For example, an alarm may sound in the event that the rotational speed of a pneumatic grinder exceeds a predetermined limit, such as may be due to regulator malfunction. In other embodiments, a controller may shut down an instrumented hand tool if a registered value exceeds a threshold or predetermined limit.

In other embodiments, the controller may communicate the control signal to one or more actuators on the hand tool to automatically effect a desired change in a process parameter. For example, the controller may actuate a valve to increase air flow rate which, in turn, may influence orbital and/or rotational rates of motion. The controller may also adjust supply line pressure by, for example, actuating valves associated with a pressure bleed line. In some embodiments, the controller may adjust tool conditions so as to alleviate one or more symptoms, such as those which may be associated with long term use of the hand tool by an operator. For example, the controller may be in communication with a vibration sensor and adjust one or more operational parameters so as to manage carpal tunnel syndrome. Likewise, it is further envisioned that the controller may automatically generate a desired or uniform surface finish on a work piece by adjusting operational parameters of the hand tool in response to deviations from predetermined limits. Other forms of analysis may also be performed by the controller on collected data depending upon the software and algorithms executed by the controller.

As discussed above, the disclosed methods may be performed manually or implemented automatically through use of a controller incorporated into the system. The controller may be implemented using one or more computer systems, for example, a general-purpose computer such as those based on an Intel PENTIUM®-type processor, a Motorola PowerPC® processor, a Sun UltraSPARC® processor, a Hewlett-Packard PA-RISC® processor, or any other type of processor or combinations thereof. Alternatively, the computer system may include specially-programmed, special-purpose hardware, for example, an application-specific integrated circuit (ASIC) or controllers intended for process monitoring systems.

The computer system can include one or more processors typically connected to one or more memory devices, which can comprise, for example, any one or more of a disk drive memory, a flash memory device, a RAM memory device, or other device for storing data. The memory is typically used for storing programs and data during operation of a process monitoring system and/or the computer system. For example, the memory may be used for storing historical data relating to process parameters over a period of time, as well as operating data. The data can then be recalled from the memory at a future time, and may be further analyzed and/or processed.

Software, including programming code that implements embodiments of the invention, can be stored on a computer readable and/or writeable nonvolatile recording medium, and then typically copied into the memory wherein it can then be executed by the processor. Such programming code may be written in any of a plurality of programming languages, for example, Java, Visual Basic, C, C#, or C++, Fortran, Pascal, Eiffel, Basic, COBAL, or any of a variety of combinations thereof. Various types of software can be executed by the controller depending on the type of data analysis desired.

Components of the computer system may be coupled by one or more interconnection mechanisms, which may include one or more busses (e.g., between components that are integrated within a same device) and/or a network (e.g., between components that reside on separate discrete devices). The interconnection mechanism typically enables communications (e.g., data, instructions) to be exchanged between components of the computer system.

The computer system can also include one or more input devices, for example, a keyboard, mouse, trackball, microphone, touch screen, and other man-machine interface devices as well as one or more output devices, for example, a printing device, display screen, or speaker. In addition, the computer system may contain one or more interfaces that can connect the computer system to a communication network (in addition or as an alternative to the network that may be formed by one or more of the components of the computer system).

According to one or more embodiments of the invention, the one or more input devices may include sensors for measuring parameters of a hand tool operating system and/or components thereof. Alternatively, the sensors and/or other components may be connected to a communication network that is operatively coupled to the computer system. Any one or more of the above may be coupled to another computer system or component to communicate with the computer system over one or more communication networks. Such a configuration permits any sensor or signal-generating device to be located at a significant distance from the computer system and/or allow any sensor to be located at a significant distance from any subsystem and/or the controller, while still providing data therebetween. Such communication mechanisms may be effected by utilizing any suitable technique including, but not limited to, those utilizing wireless protocols.

The controller can include one or more computer storage media such as readable and/or writeable nonvolatile recording medium in which signals can be stored that define a program to be executed by one or more processors. The medium may, for example, be a disk or flash memory. In typical operation, the processor can cause data, such as code that implements one or more embodiments of the invention, to be read from the storage medium into a memory that allows for faster access to the information by the one or more processors than does the medium. The memory is typically a volatile, random access memory such as a dynamic random access memory (DRAM) or static memory (SRAM) or other suitable devices that facilitates information transfer to and from the processor.

It should be appreciated that the invention is not limited to being implemented in software, or on the computer system as exemplarily discussed herein. Indeed, rather than implemented on, for example, a general purpose computer system, the controller, or components or subsections thereof, may alternatively be implemented as a dedicated system or as a dedicated programmable logic controller (PLC) or in a distributed control system. Further, it should be appreciated that one or more features or aspects of the invention may be implemented in software, hardware or firmware, or any combination thereof. For example, one or more segments of an algorithm executable by controller can be performed in separate computers, which in turn, can be communicated through one or more networks.

In accordance with one or more embodiments, an instrumented hand tool may include communication equipment, such as wireless equipment, to enable remote monitoring. For example, an instrumented hand tool may be equipped with radio frequency (RF) capability. Process parameters, including contact time, may be remotely monitored, and data may be recorded and/or stored for analysis.

In some applications, such as those implemented at a manufacturing facility where a plurality of hand tool operators function simultaneously, data on each operator may be transmitted to a central receiver, such as to a supervisory control and data acquisition (SCADA) system. The data may be stored for future recall and process analysis. Data analysis can be performed for individual hand tool operators, or, alternatively, at the production line level, or even for the entire manufacturing plant depending on the type of information deemed useful. Trends may be analyzed, for example, to aid in accounting for and/or correcting variations in operator experience and technique. For example, instrumented sanders in accordance with one or more embodiments of the present invention may be used to analyze the distribution of air pressure throughout a production facility. Station-to-station variation may be recorded, and this information may be correlated to plant productivity issues. The data may be useful as an engineering service tool, such as to facilitate the outlining and/or implementation of a compressed air distribution improvement plan.

In other applications, hand tools instrumented in accordance with one or more embodiments of the present invention may be implemented in the training of hand tool operators. For example, the instrumented hand tools may be used to demonstrate the cause and effect relationships involving manipulation of various operational parameters. In at least one embodiment, the impact of one or more operational parameters, such as air supply, pressure and/or contact area may be demonstrated, for example, with respect to productivity, surface finish, surface quality and/or surface appearance.

Economic analysis can also be performed using the data collected from the various sensors of the present invention. For example, consumption data (e.g. power consumption, scrap material generation, etc.) might aid in energy management and evaluating manufacturing costs. It is envisioned that such information could be communicated to operators, supervisors, plant management, or purchasing agents.

As discussed, quantitative analysis can be conducted on data collected by the sensors of the present invention. Data analysis can lead to an understanding of relationships and interplay between operational parameters. These relationships can be evaluated and applied in applications engineering to optimize hand tooling processes. Stored data may be used to facilitate isolation of machine variables that may hinder the performance results of products in development, as well as those in production. Analysis of data regarding operational parameters, such as process time, may facilitate enhancing efficiency, increasing operator productivity, and establishing production standards used in scheduling and/or costing. Operational parameter settings may be determined by a user for an intended hand tool application, as well as changed and/or updated by the user.

In operation, experimental runs may be performed to establish desired parameter values for a specific offhand tool application. For example, parameters such as applied force, air pressure, orbital and rotational motion as a function of grinding time, and abrasive product type may be varied among experimental runs. Data collected by various sensors can then be analyzed to establish allowable ranges for input and process parameters such that targets for economic and technical outputs (e.g. productivity, abrasive product consumption, surface parameters and appearance, scrap generation) may be achieved for a given offhand tool application. For example, surface appearance may vary depending upon the applied sanding technique. Variations in surface quality among sanded work pieces may be magnified when treated with a finish, such as a stain. Thus, it may be desirable to quantify the effect of key input parameters on surface appearance to establish desired tooling conditions such as acceptable values for various operational parameters.

Desired and/or allowable parameter values vary among intended applications. Application-specific parameter settings and/or ranges may be implemented and/or stored for future recall. For example, an established parameter setting for a specific application may be recalled when performance of the specific application is desired. The application-specific parameter setting may then be inputted to a hand tool operation system described herein, for example, as a predetermined limit for an operational parameter, to aid in performing the intended application.

In some applications, stored historical data may be recalled to establish an operational parameter setting for a current hand tool process. For example, a hand tool operator may seek to manufacture an end-product substantially similar to a specific specimen produced at some point in the past. Data collected at the time the model specimen was created may be recalled to provide information on desired operational parameter settings. These settings may then be presently implemented to facilitate reproduction.

The collected data may also provide information useful in evaluating steps to be taken to improve performance of the hand tool, such as servicing or maintenance. For example, in applications where the hand tool is a grinder or sander, changes in the dust generation rate or in the revolutions per minute of the abrasive product may reflect a need for replacement of the abrasive product. In some embodiments, it is also envisioned that critical measurements commonly known to reflect changes in the hand tool operation or surface generation process may also be displayed for the operator. In some applications, the diagnostic capability of the disclosed instrumented hand tools may be used to develop an algorithm, such as in collaboration with an original equipment manufacturer (OEM), capable of notifying an operator of potential servicing requirements. For example, the algorithm may notify an operator of a pneumatic sanding machine that an abrasive product is worn and/or ready for discard so as to assure a high level of productivity and quality.

The invention contemplates the modification of existing hand tools in order to implement the techniques of the present invention. Thus, for example, an existing hand tool or work space can be retrofitted to include one or more sensors for monitoring operational parameters of the hand tool. Existing manufacturing facilities can be equipped with various displays for communicating collected data regarding an operational parameter to an operator of the hand tool. Furthermore, a controller and data storage systems configured in accordance with one or more embodiments exemplarily discussed herein may be provided.

EXAMPLES

The function and advantages of these and other embodiments of the present invention will be more fully understood from the following examples. These examples are intended to be illustrative in nature and are not to be considered as limiting the scope of the invention.

Example 1

This example illustrates one or more embodiments of the present invention directed to monitoring the impact that variation in supplied air pressure has on various operational parameters of a pneumatic dual action (DA) hand sander.

Figure 2:
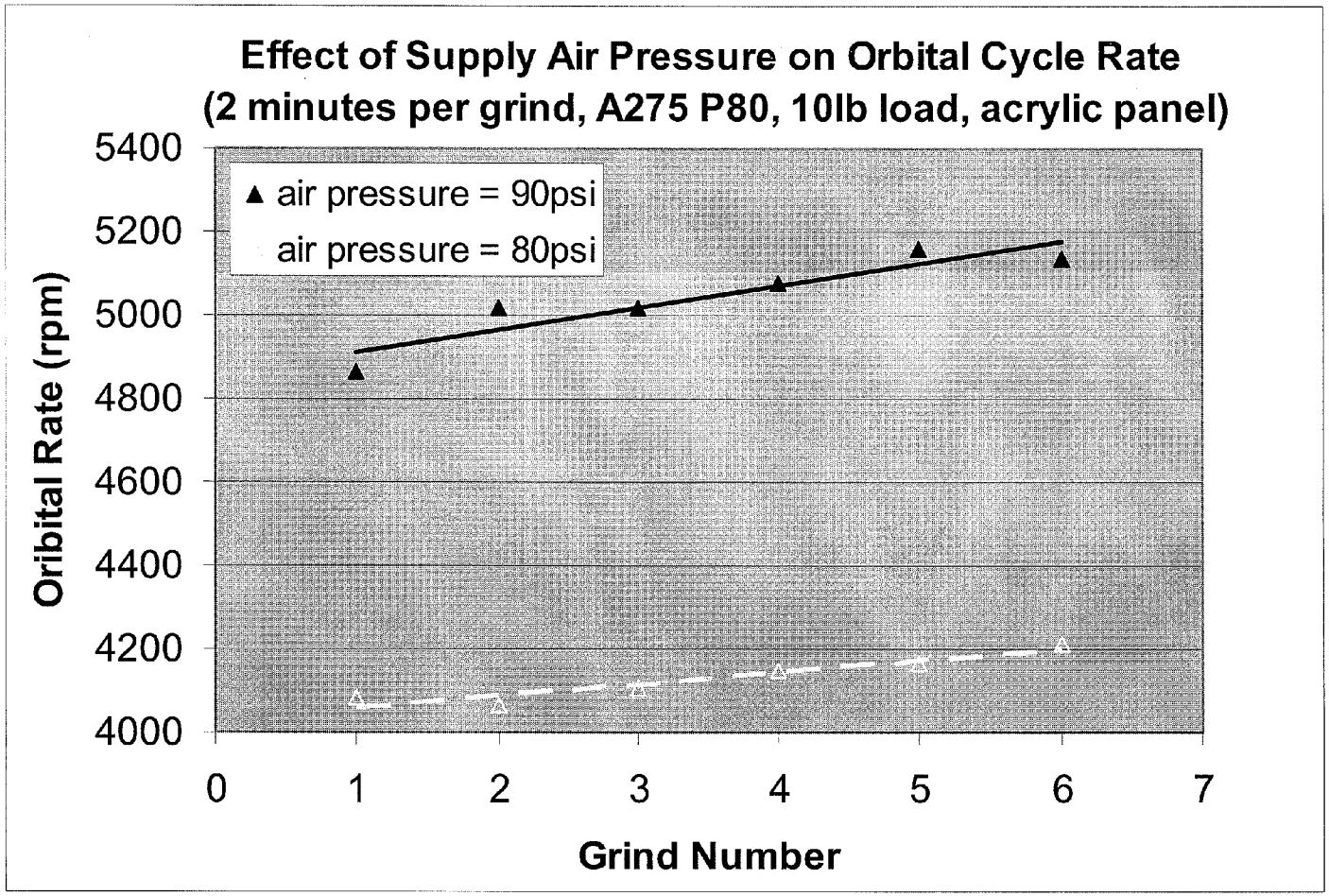
FIG. 2 presents a data plot illustrating the effect of supply air pressure on orbital cycle rate as discussed in Example 1.
Figure 3:
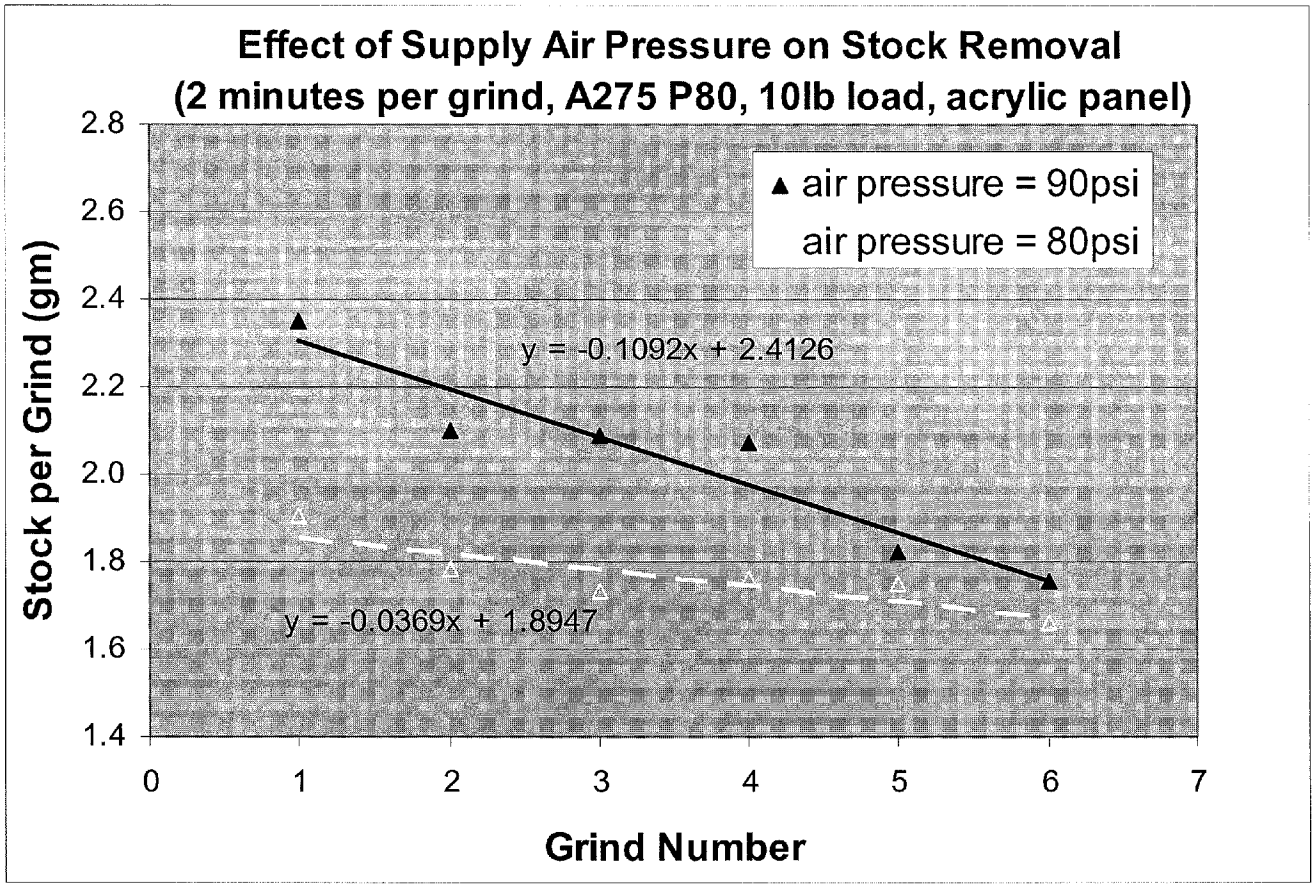
FIG. 3 presents a data plot illustrating the effect of supply air pressure on stock removal rate as discussed in Example 1.

As illustrated in FIGS. 2 and 3, two experimental runs were performed using a DA hand sander outfitted with A275P80 abrasive product commercially available from Saint-Gobain Abrasives, Inc. In each run, a series of seven grinds was performed on a single acrylic panel at a rate of 2 minutes per grind, applying a 10 pound normal grinding force to the panel during each grind. The first run was performed supplying the DA sander with an inlet air pressure of 90 psi, while the second run was performed with an inlet air pressure of 80 psi. Both the orbital rate of the DA sander and the amount of stock removed per grind were monitored.

As indicated by the data in FIG. 2, the orbital rate increased with grind number in both experimental runs. At a constant applied normal force, the orbital rate increased as the abrasive product wore down with use. The DA sander also operated at an overall lower orbital rate at the lower supplied air pressure. As illustrated in FIG. 3, supplied air pressure had a significant impact on material removal rate through the orbital frequency of the abrasive disc. A change in air pressure from 90 to 80 psi resulted in an initial reduction of approximately 20% in stock removed per grind for fresh abrasive discs. Cumulative stock removed over the twelve minute test period was about 15% larger at 90 psi versus 80 psi (12.2 g at 90 psi; 10.6 g at 80 psi). However, the data presented in FIG. 3 indicated that a lower air pressure may provide a more consistent stock removal rate in time, which could be advantageous in a production environment.

Example 2

This example illustrates one or more embodiments of the present invention directed to monitoring the impact that applied normal force has on stock removal per grind during operation of a pneumatic DA hand sander.

Figure 4:
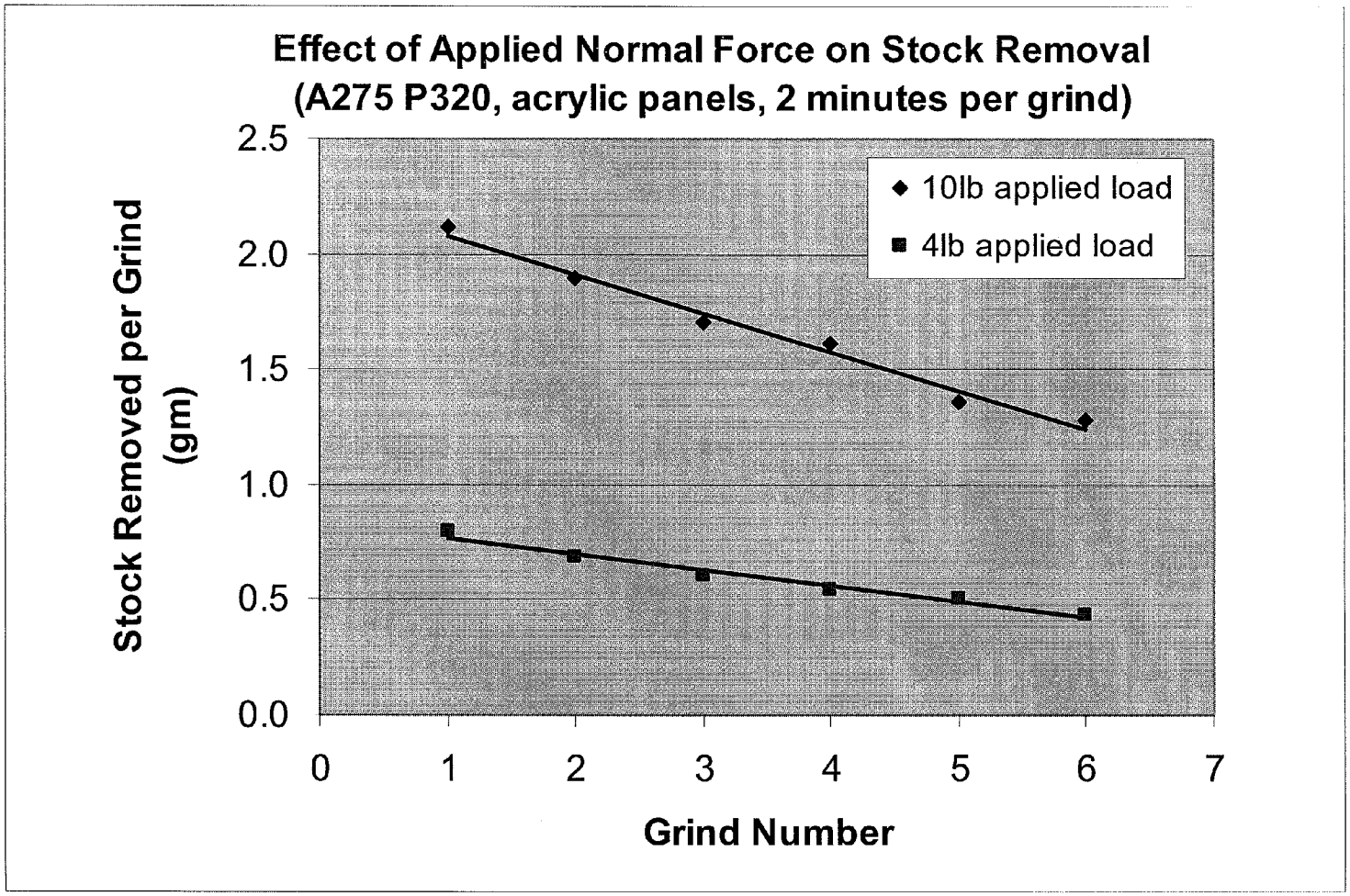
FIG. 4 presents a data plot illustrating the effect of applied normal force on stock removal rate as discussed in Example 2.

As illustrated in FIG. 4, two experimental runs were performed using a DA hand sander outfitted with A275 P320 abrasive product commercially available from Saint-Gobain Abrasives, Inc. In each run, a series of seven grinds was performed on a single acrylic panel at a rate of 2 minutes per grind and at a constant supplied air pressure. The first run was conducted applying a normal force of 10 pounds while the second run was conducted while applying a normal force of 4 pounds. FIG. 4 illustrates the effect of applied normal force on stock removed as a function of grinding time for a single abrasive product. The applied normal force influenced the stock removal rate. The grain depth of cut increased with increasing load, thereby increasing the stock removed per unit time. Thus, the stock removal rate increased with increasing applied force. For each applied load, the amount of stock removed decreased with grind number, indicating that the abrasive product wore down over time. The data in FIG. 4 also indicated that a lower applied load may provide a more consistent removal rate over time.

Example 3

This example illustrates one or more embodiments of the present invention directed to monitoring the impact that different types of abrasive products may have on the orbital rate of a hand sander.

Figure 5:
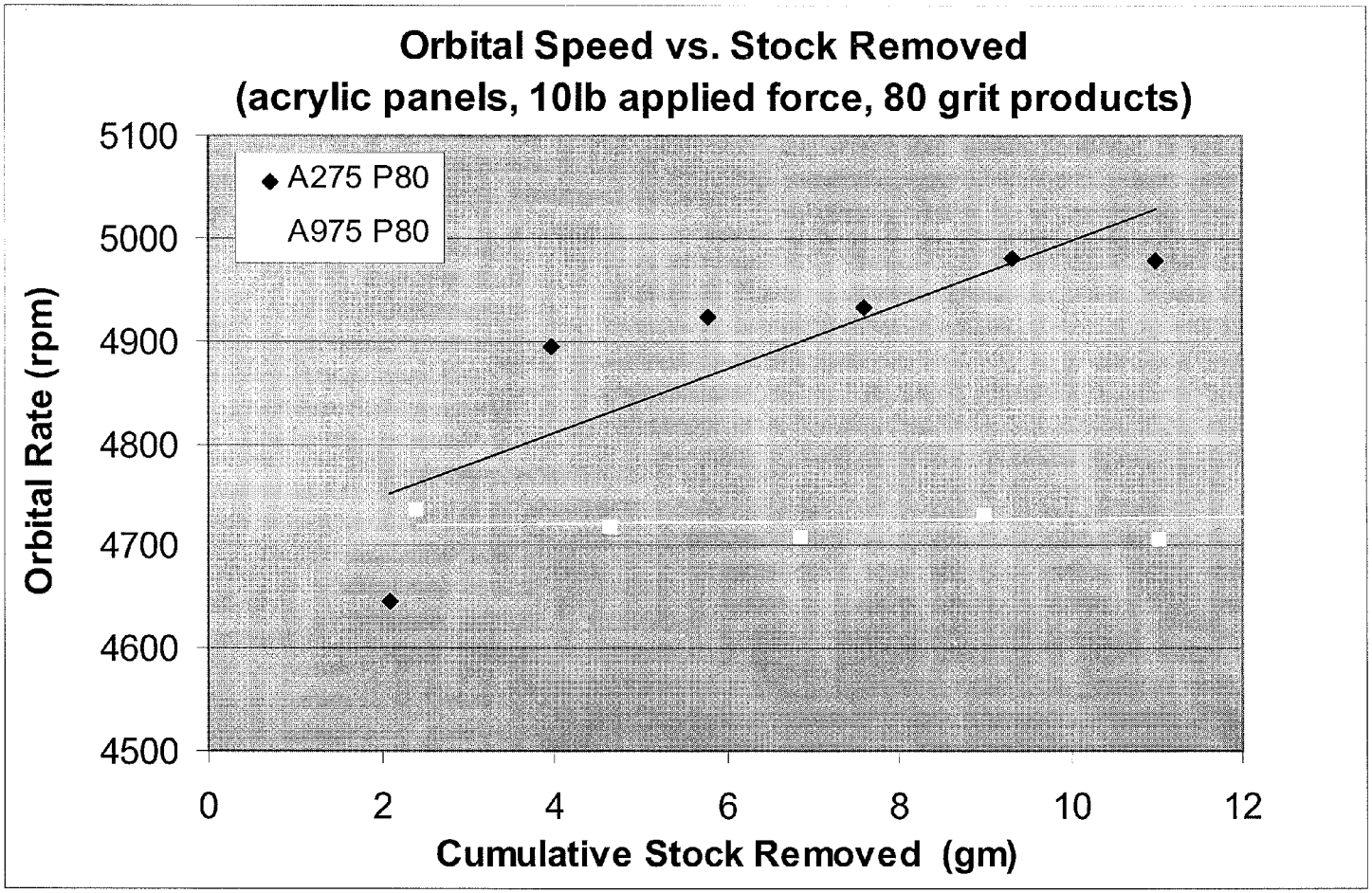
FIG. 5 presents a data plot illustrating cumulative stock removed as a function of orbital rate for different abrasive products as discussed in Example 3.
Figure 6:
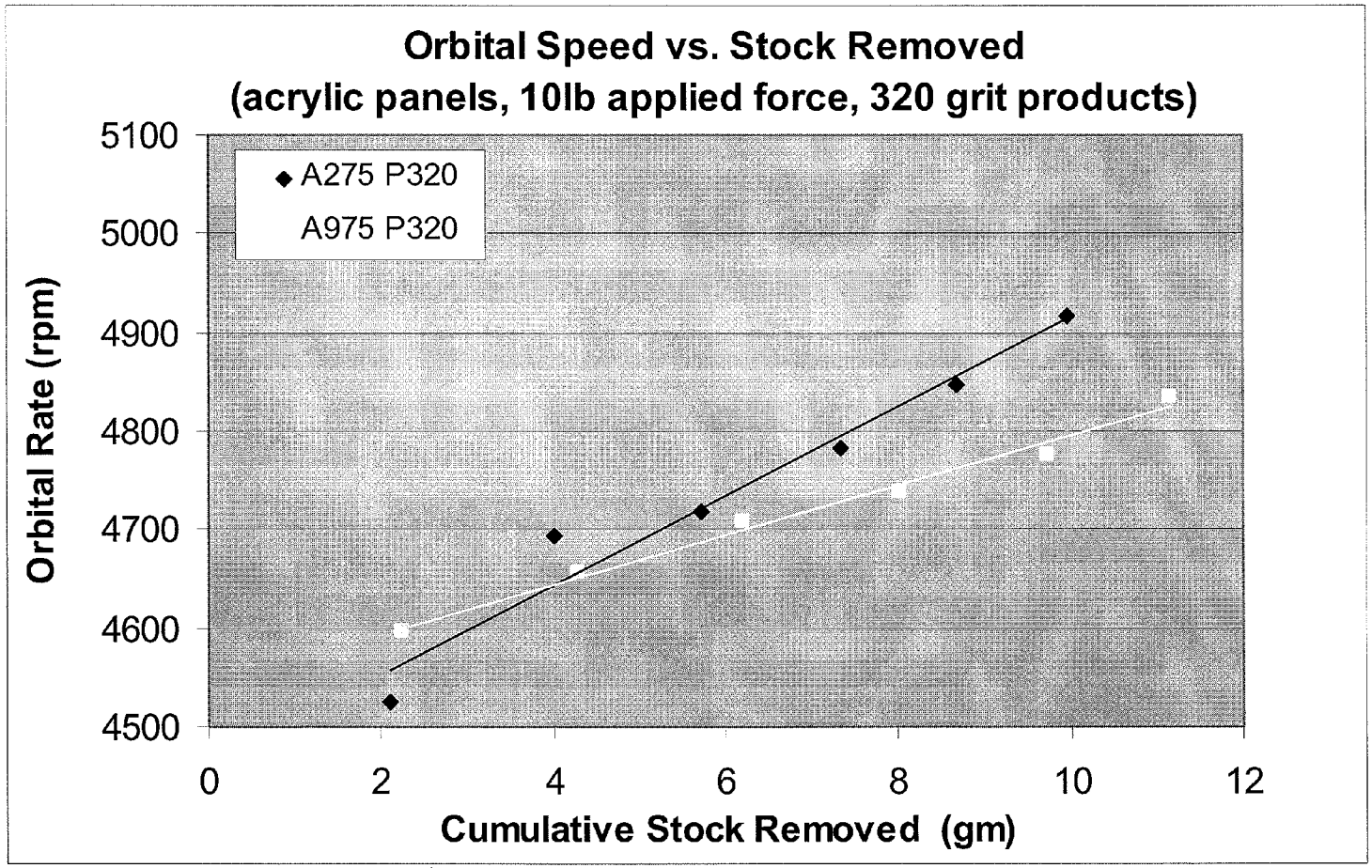
FIG. 6 presents a data plot illustrating cumulative stock removed as a function of orbital rate for different abrasive products as discussed in Example 3.

FIGS. 5 and 6 illustrate cumulative stock removed as a function of orbital cycle rate at constant air supply pressure and grinding force for two different abrasive grain sizes (80 grit and 320 grit) in two product formulations, namely A275 and A975 both commercially available from Saint-Gobain Abrasives, Inc. The orbital rate of the motor was influenced by grinding time and by the properties of the abrasive product. As illustrated in FIG. 5, the orbital rate remained relatively constant with increased cumulative stock removed using the A975 80 grit product, while the orbital rate increased along with cumulative stock removed using the A275 80 grit product. The data of FIG. 6 indicates that the orbital rate increased along with cumulative stock removed for both of the 320 grit products at a constant applied force due to abrasive wear, with a greater net change in orbital rate for the A275 320 grit product. Control of the appearance of the work surface and productivity of the operation is linked to understanding these relationships between abrasive product type and time-dependent abrasive wear behavior in terms of its influence on material removal rate and the kinematics of the process (orbital and rotational disc motions) for a given applied load.

Example 4

This example illustrates the relationship between applied normal grinding force and the resulting abrasive disc orbital cycle rate during operation of a hand sander.

Figure 7:
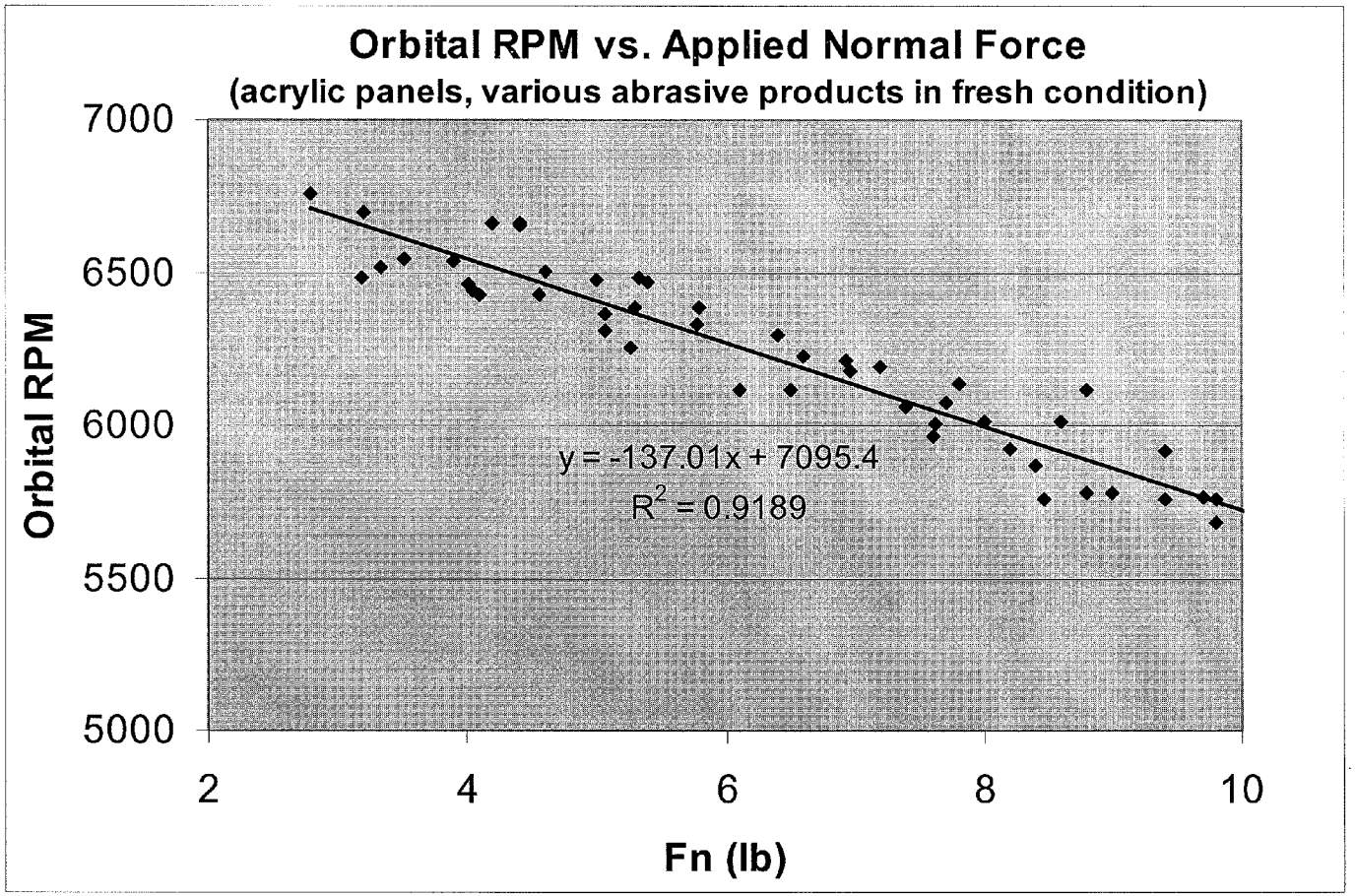
FIG. 7 presents a data plot illustrating orbital motion versus applied normal force as discussed in Example 4.

A plurality of experimental runs was performed using a variety of abrasive products. In each experimental run, an abrasive product in fresh condition was used to treat an acrylic panel surface. The applied normal grinding force was varied among experimental runs and, for each run, the orbital rate of the hand sander was measured when the fresh coated abrasive contacted the acrylic surface. FIG. 7 illustrates the collected data in a scatter plot of orbital cycle rate against applied normal force. The data indicated an inverse relationship between applied normal force and orbital rate for a variety of fresh abrasive products. This information can, for example, be correlated to the appearance of a treated surface or other effect that the sanding operation has on the treated surface. By measuring force and orbital rate, the process can be maintained to generate consistent desired surface quality over time. Both the orbital and the purely rotational components of the abrasive disc motion can be measured.

Example 5

This example illustrates an embodiment of the present invention directed to capturing process variations between surface sanding operations using new abrasive product and depleted abrasive product. The experimental runs discussed herein were conducted in a custom cabinetry shop. An operator used an instrumented sander to smooth a wood surface while monitoring operational parameters of the sander on a computer display. The sander utilized PB273P180 abrasive discs commercially available from Saint-Gobain Abrasives, Inc.

Figure 8:
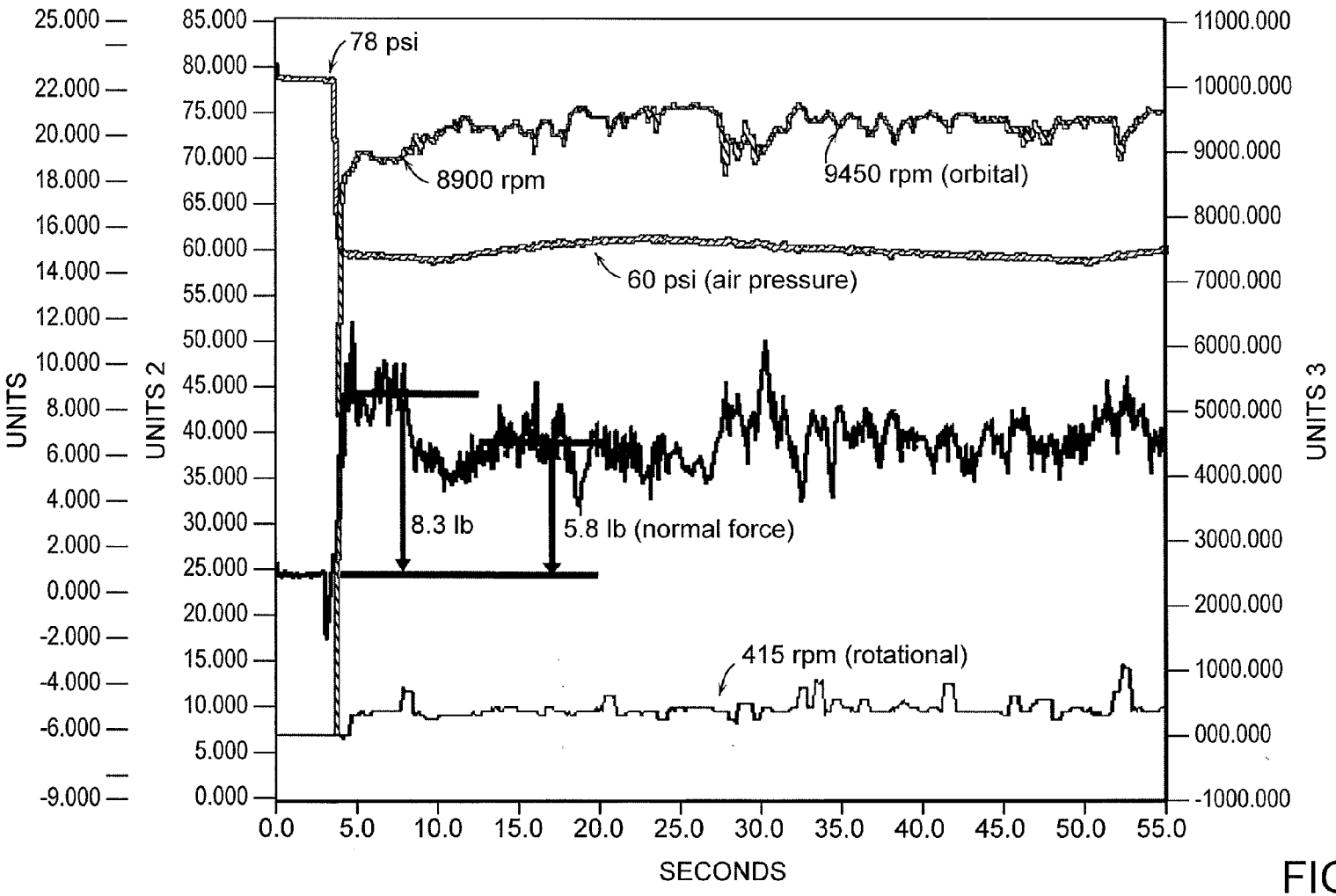
FIG. 8 presents experimental data on various operational parameters collected during use of a new abrasive disc as discussed in Example 5.
Figure 9:
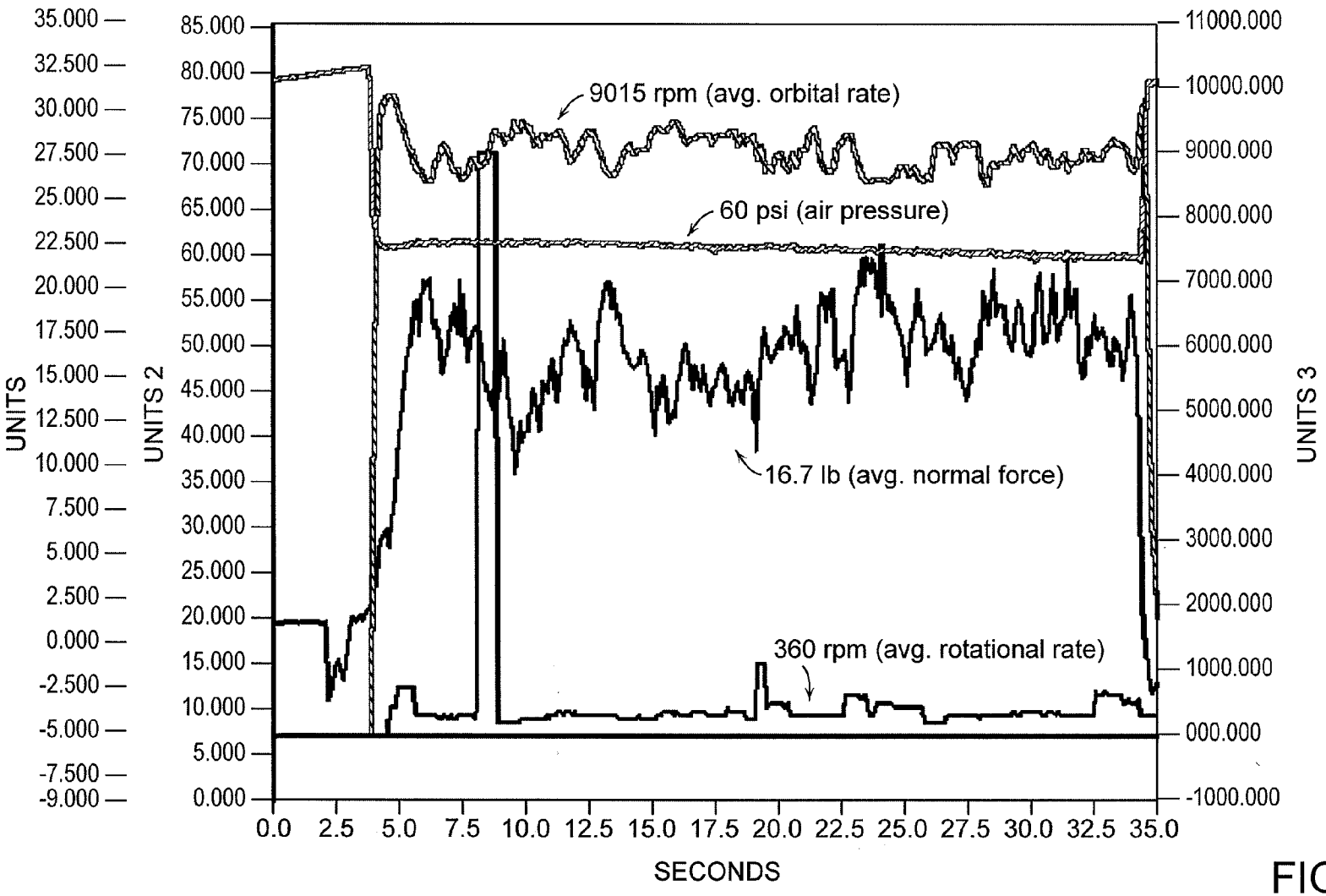
FIG. 9 presents experimental data on various operational parameters collected during use of a worn abrasive disc as discussed in Example 5.

FIG. 8 illustrates data collected in an experimental run using a new abrasive disc, and FIG. 9 illustrates data collected in an experimental run using a worn abrasive disc. Both experimental runs were conducted while supplying the same amount of air pressure, 60 psi, as indicated in FIG. 10. The normal force applied to the work piece was increased in each experimental run until the operator could feel sanding action. The data presented in FIG. 10 captured snapshots of certain operational parameters at the point in each experimental run when such sanding action could first be felt by the operator. As quantified, almost a three-fold increase in applied force was required for the worn abrasive disc. The process comparison data presented in FIG. 10 also indicates that disc motion rates decreased with increased applied force. Collection and analysis of this type of data could be helpful in adjusting operational parameters to maintain constant sanding action as an abrasive product gets worn down with use.

Example 6

Figure 11:
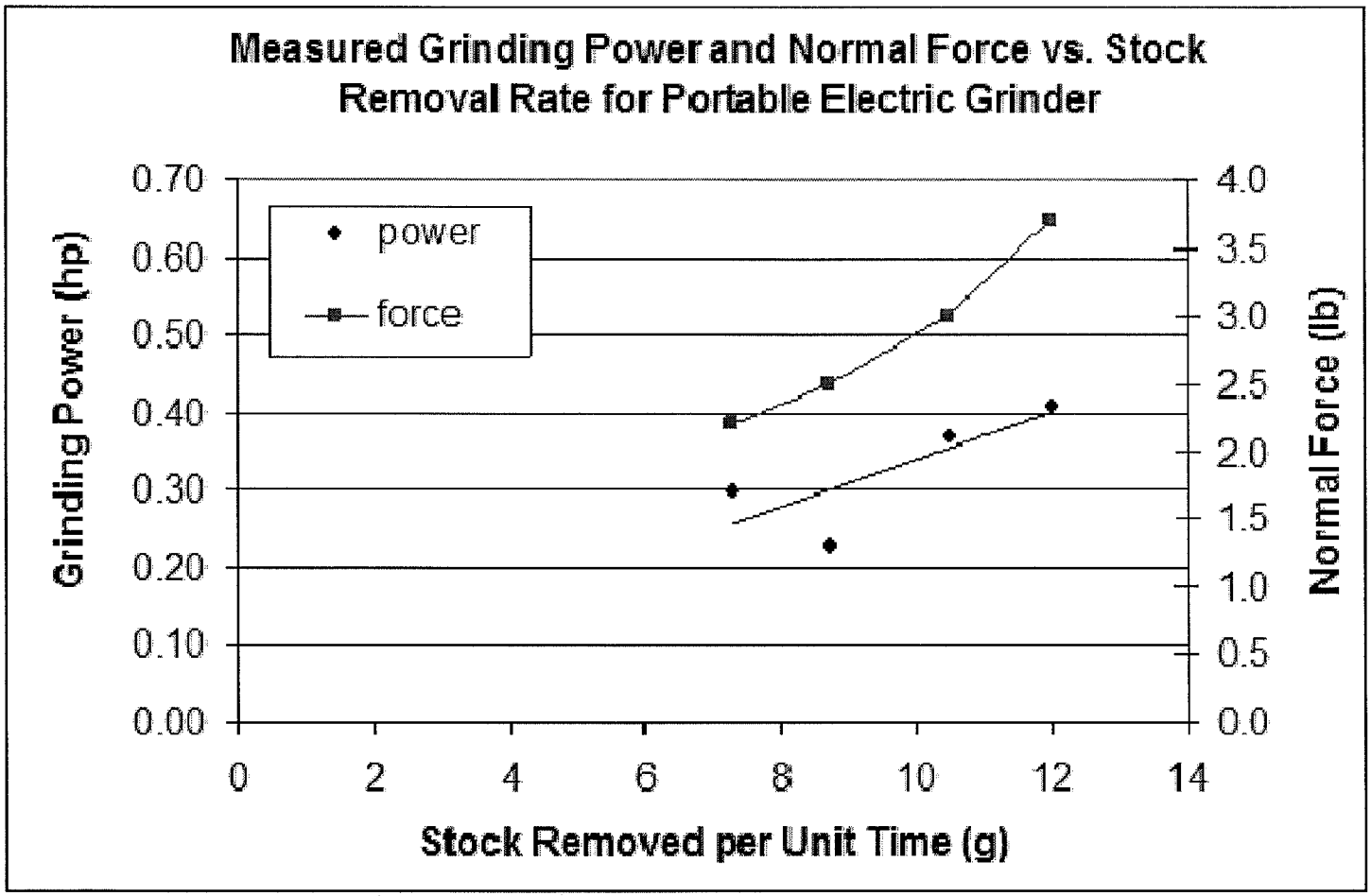
FIG. 11 presents experimental data illustrating the effect of grinding power and normal force applied on stock removal rate as discussed in Example 6.

This example illustrates an embodiment of the present invention directed generally to the monitoring of portable electric grinders. A sample of 1018 steel was mounted on a dynamometer to measure the force applied by a Black and Decker® Wildcat electric grinder equipped with a flap disc abrasive. For each experimental run, the abrasive was brought into contact with the sample for about one minute. The stock removal rate was monitored. Current and voltage were also both measured. The current and voltage measurements were used to calculate the motor power of the electric grinder. The collected data is presented in FIG. 11 and illustrates trends in normal force and power on stock removal rate. The data indicates that power can be correlated to the applied force and the stock removal rate.

It should be appreciated that numerous alterations, modifications and improvements may be made to the illustrated systems and methods. Other embodiments of the systems and methods of the present invention are envisioned beyond those exemplarily described herein.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is:

1. A hand tool monitoring system, comprising:

a plurality of sensors positioned to detect a plurality of different operational parameters of a hand tool;

a controller;

a memory system; and a display;

wherein one of the plurality of sensors is a force sensor and another of the plurality of sensors detects a parameter selected from the group consisting of supplied air pressure, orbital RPM, rotational RPM, power consumption, and current, and wherein the memory system is configured to store data collected by the plurality of sensors, and wherein the controller is in communication with the plurality of sensors, the display, and the memory system, and wherein the controller is configured to generate a signal based on the data collected by the plurality of sensors, to communicate the signal to an operator of the hand tool, and to recall the stored data from the memory system.

2. The system of claim 1, wherein the hand tool is a pneumatic device.

3. The system of claim 2, wherein the hand tool is a sander comprising a coated abrasive.

4. The system of claim 2, wherein the hand tool is a grinder comprising a thin wheel abrasive.

5. The system of claim 1, wherein the hand tool is a grinder comprising a bonded abrasive.

6. The system of claim 1, wherein the one of the plurality of sensors is an air pressure sensor.

7. The system of claim 1, wherein the one of the plurality of sensors is a motion sensor.

8. The system of claim 1, wherein the one of the plurality of sensors is an air flow rate sensor.

9. The system of claim 1, wherein the data collected by the plurality of sensors is stored in the memory system as historical data.

10. The system of claim 9, wherein the historical data is displayed to the operator of the pneumatic hand tool.

11. The system of claim 1, wherein the controller is further configured to communicate a predetermined limit for the operational parameter to the operator.

12. The system of claim 1, wherein the controller is further configured to compare the data collected by the plurality of sensors to a predetermined limit for the operational parameters.

13. The system of claim 12, wherein the controller is further configured to generate a control signal in response to the data collected by the plurality of sensors deviating from the predetermined limit to adjust the operational parameters.

14. The system of claim 13, wherein the controller is further configured to communicate the control signal to the operator.

15. The system of claim 1, further comprising a central receiver in communication with the plurality of sensors.

16. The system of claim 15, wherein the controller is further configured to transmit the data collected by the plurality of sensors to the central receiver.

17. A pneumatic hand tool monitoring system, comprising:

a plurality of sensors positioned to detect a plurality of different operational parameters of the pneumatic hand tool;

a controller;

a memory system; and a display;

wherein one of the plurality of sensors is a force sensor and another of the plurality of sensors detects a parameter selected from the group consisting of supplied air pressure, orbital RPM, rotational RPM, power consumption, and current, and wherein the memory system is configured to store data collected by the plurality of sensors, and wherein the controller is in communication with the plurality of sensors, the display, and the memory system, and wherein the controller is configured to generate a signal based on the data collected by the plurality of sensors, to communicate the signal to an operator of the pneumatic hand tool, and to recall the stored data from the memory system.

18. The system of claim 17, wherein the pneumatic hand tool is a sander comprising a coated abrasive.

19. The system of claim 17, wherein the sensor is an air pressure sensor.

20. The system of claim 17, wherein the sensor is an air flow rate sensor.

21. The system of claim 17, wherein the data collected by the plurality of sensors is stored as historical data.

22. The system of claim 17, wherein the pneumatic hand tool is a grinder comprising a bonded abrasive.

23. The system of claim 17, wherein the pneumatic hand tool is a sander comprising a thin wheel abrasive.

24. The system of claim 21, wherein the historical data is displayed to the operator of the pneumatic hand tool.

* * * * *